United States Patent [19]

Pemrick et al.

[11] 4,035,961

[45] July 19, 1977

[54] COATED ABRASIVE BACKING OF DIMENSIONALLY STABILIZED HEAT STRETCHED FABRIC

[75] Inventors: Raymond E. Pemrick, Schenectady; Paul M. Cocanour, Greenwich, both of N.Y.

[73] Assignee: Norton Company, Worcester, Mass.

[21] Appl. No.: 590,989

[22] Filed: June 27, 1975

Related U.S. Application Data

[63] Continuation-in-part of Ser. No. 491,354, July 24, 1974, abandoned.

[51] Int. Cl.[2] ..... B24D 11/02

[52] U.S. Cl. ..... 51/295; 51/298 A

[58] Field of Search ..... 51/295, 296, 298

[56] References Cited

U.S. PATENT DOCUMENTS

| | | | |
|---|---|---|---|
| 2,817,371 | 12/1957 | Bussiere | 51/298.1 |
| 3,044,891 | 7/1962 | Lauchenauer et al. | 51/298 |
| 3,074,789 | 1/1963 | Krogh | 51/293 |
| 3,136,614 | 6/1964 | Kuzmick | 51/297 |
| 3,316,072 | 4/1967 | Voss | 51/294 |
| 3,787,273 | 1/1974 | Okrepkie et al. | 51/298 |
| 3,861,892 | 1/1975 | Wisdom et al. | 51/294 |

*Primary Examiner*—Donald J. Arnold
*Attorney, Agent, or Firm*—Rufus M. Franklin

[57] ABSTRACT

A woven heat stretched fabric of polyester fiber yarns is provided which offers an improved, dimensionally stable backing member for the manufacture of coated abrasive material. Coated abrasive material incorporating this backing member is characterized by suitably controlled elongation characteristics.

5 Claims, 3 Drawing Figures

COATED ABRASIVE BACKING OF DIMENSIONALLY STABILIZED HEAT STRETCHED FABRIC

RELATIONSHIP TO OTHER APPLICATIONS

This application is a continuation-in-part of our copending application Ser. No. 491,354, filed July 24, 1974 and now abandoned.

BACKGROUND OF THE INVENTION

1. Field of the Invention

This invention relates to woven fabrics of polyester fibrous yarns which will be found highly suitable as backing members in the manufacture of coated abrasive material and to their manner of manufacture as well as the coated abrasive material manufactured therefrom.

2. Description of the Prior Art

Coated abrasive material, or as it is more commonly known "sandpaper", is made of a flexible backing member to which is applied an adhesive layer and abrasive grain.

The flexible backing member of the coated abrasive material is, in general, a woven fabric of cellulosic yarn, i.e., cotton staple yarn; however, the prior art has also disclosed the use of yarns of man-made fibers such as nylon, polyester, polypropylene, polyethylene, and glass. Representative of this latter prior art are U.S. Pat. Nos. 2,712,987; and 3,316,072; and Canadian Pat. Nos. 676,601 to Hansen, Pemrick, and Sprague and No. 744,667 to Pemrick and Gladstone, Pemrick being one of the inventors named herein. Others include U.S. Pat. Nos. 2,672,715; 2,740,239; 3,246,969; and 3,487,593.

As received from the mill, or cloth manufacturer, cotton fabric backing members are too permeable and the greige fabric possesses too much inherent longitudinal stretch to be suitable, as is, as a backing member for coated abrasive manufacture. Because of this, the fabric is subjected to a "cloth finishing" operation whereby the fabric is subjected to a number of different separate and distinct operations. This includes dyeing the greige fabric brown or blue, or some other desirable color for identification purposes, followed by pull-down or longitudinal stretching of the fabric to align the fibers and to impart to the fabric some desired dimensional stability. Afterwards, the fabric may be subjected to one or more backing filling operations, followed by application of a back size and front size composition. To the front side of the fabric may be further applied another coat providing for improved adhesion with the maker adhesive to be applied.

These various and sundry cloth finishing steps have been considered necessary in the past to provide, among other things, suitable flexibility in the backing member and dimensional stability in the coated abrasive material. The back fill and front size operations have been considered critical where a heat-hardened resinous maker adhesive is to be utilized in coated abrasive manufacture; otherwise, the adhesive will penetrate into the cotton backing member and embrittle the cellulosic yarns.

It was to eliminate or at least reduce the number of distinct operations involved in the cloth finishing of cotton fabric backing members, as well as, among other things, to provide coated abrasive material of improved flexibility and durability, that first led to the invention disclosed in Canadian Pat. No. 676,601. Therein, as disclosed by the patentees, woven fabric backing members of isotactic polypropylene, linear and branched polyethylene, and polyester yarns, of either staple fibers or continuous filaments, result in minimum cloth treatment, compared to cotton fabrics, to prepare the fabric for use as a coated abrasive backing member.

As disclosed in Canadian Pat. No. 676,601, the fabric therein can be dimensionally stabilized by heating it to a temperature below but near the melting point of the yarn, while the fabric is tentered or relaxed. This causes some shrinkage in the fabric, resulting in a denser fabric, and heat sets the fabric. On the other hand, where the fabric is tentered during heating, the fabric is heat set in its original dimension.

To avoid the occurrence of excessive elongation where a woven fabric is to be used as a backing member to manufacture abrasive material, it has been customary, to build into the woven fabric and therefore into the coated abrasive material, the various strength elongation, and other characteristics desired. This has been accomplished in the past by using yarns of certain desired fibrous materials, e.g., cotton, sizes, and fabrics of certain construction, i.e., thread count, yarn number, weave patterns, etc.

Standard fabric constructions result in fabric cover factors, in the greige fabric, in the range of 80% to 95%. In other words, the openness or air space in the fabric is of the order of 5% to 20%. The percent cover factor is defined as 100 - % air space;

$$\frac{\%\ \text{warp cover}}{100} = \frac{\text{ends/in.}}{28\sqrt{n}}\ ;\ \frac{\%\ \text{fill cover}}{100} = \frac{\text{picks/in.}}{28\sqrt{n}}\ ;$$

$n$ = yarn number. Thus,

% cover =

$$100 - \left(\frac{\%\ \text{warp air space}}{100} \times \frac{\%\ \text{fill air space}}{100}\right) \times 100$$

After pull-down during cloth finishing, the cover is from about 85 to 96%.

The use of man-made fiber fabrics heretofore as backing members for coated abrasive material, except for polynosic rayon, has met with only very limited success. Among other things, especially with polyester fabrics, adhesion between the backing member and the maker adhesive has not been completely satisfactory. Conventional maker adhesives of phenolic resins do not wet polyester fibers; therefore no chemical bonding occurs between the maker adhesive and backing member. Adhesion is solely mechanical and this has been found to be somewhat limited. This results in shedding of the abrasive grain when the abrasive material is still useful.

One of the major problems, however, in the past deterring the use of man-made fiber fabrics results from the fact that, e.g., available polyester fabrics have lacked suitable dimensional stability. This is particularly true even where these fibrics are dimensionally stabilized as mentioned in Canadian Pat. No. 676,601, particularly where the coated abrasive material is used in the manufacture of larger abrasive belts such as used in plywood sanding or in applications where the coated abrasive belt is subjected to relatively high tensile forces.

A fabric can be somewhat dimensionally stabilized by either stretching the fabric, and this is disclosed in the prior art, or already stretched yarns can be used in weaving the fabric. This is the manner of providing a dimensionally stabilized coated abrasive backing member of nylon film disclosed in U.S. Pat. No. 2,712,987, earlier mentioned in the description of the prior art. U.S. Pat. No. 3,517,425 disclosed heat stretching tire fabric to reduce its elongation in use.

Other means of providing some dimensional stability to fabrics involves application of coating materials to the fabric. Such a method of stabilizing a fabric is disclosed in U.S. Pat. No. 2,977,665 wherein a polymeric material such as a mixture of thermosetting and thermoplastic resins is applied to the fabric, and while the fabric is stretched, the resinous material is cured.

One might readily assume from the above prior art, that an obvious solution to undesired fabric elongation in a polyester fabric backing member in coated abrasive material, during usage of the abrasive material, would be to stretch the woven greige fabric intended to be used as a backing member even more than has been done in the past, particularly with respect to cotton fabrics. However, this approach has been found to accomplish little in the fabric constructions conventionally used except to finally result in a torn fabric. The yarns have been found to become so jammed up in the fabric being subjected to high pull-down forces to reduce elongation to the desired level that further stress on the fabric merely results in tearing.

When a backing member of polyester yarns is provided of the same cloth construction found most suitable, in cotton drills and jeans, the woven fabric has been found to have elongation at levels ranging from 25% to 85% in the warp direction and up to 135% in the fill. About 10–20% of the total elongation can be removed by conventional mechanical pull-down techniques; however, beyond this the fabric jams, i.e., during pull-down, the warp and fill yarns move closer and closer together thereby increasing percent fabric cover. When jamming occurs, increased tension only results in tearing.

Part of the remaining elongation can be removed by means of chemical stabilization, i.e., application of resinous coatings; however, this can be accomplished only at the expense of reduced physical characteristics such as tensile and tear strength. This of course is undesirable.

SUMMARY OF THE INVENTION

This invention, in its basic aspects, resides in a dimensionally stable, woven fabric backing member of polyester yarns which is defined by its warp elongation profile.

Additionally, in the preferred aspects of the invention, the fabric is characterized by a certain degree of openness which makes for improved mechanical adhesion between the maker adhesive used in the manufacture of coated abrasive material and the fabric used as a backing member.

The objects of the invention are accomplished, in general, in heat stretching a woven polyester fabric in a certain manner under controlled conditions. One begins with a woven fabric of polyester yarns having a desirable weave configuration and cover as required and then subjects this fabric to a condition of pulling stress in the length direction while heating the fabric, after which the fabric is set in the new configuration established during heat stretching.

During heat stretching, as desired in the practice of this invention, three things seem to be occurring; the fabric is pulled down, i.e., the fabric is elongated longitudinally, substantially all the crimp is removed from the individual yarns in the length direction, and the warp yarns per se are thinned or elongated, i.e., reduced in diameter, in the direction of the pulling force. The fabric is as before-mentioned, set in this new configuration. In connection with thinning of the yarns, the twist of the yarns appears to be tightened resulting in a fabric that is not only dimensionally established but possesses somewhat more elasticity.

In a more preferred aspect of the invention, the fabric is also finished with one or more resinous compositions, or mixtures of a resin and elastomeric material. This not only enhances dimensional stability somewhat but, most importantly, improves adhesion between the maker adhesive and the backing member.

We have found that openness, i.e., the degree thereof in the greige fabric, as well as in the fabric after pull-down, is most important to the accomplishment of the objects of this invention. Quite unexpectedly, we believe, we have discovered the solution to providing an improved dimensionally stable woven fabric of polyester fibers for use as a coated abrasive backing member is to begin with a more open fabric and to subject it to pull-down forces, rather than a fabric having the same or greater cover than conventional cotton fabrics. Thus, we have found that a greige fabric initially having 20–60% openness, preferably 25–35%, results in, after processing as hereinafter described, an improved dimensionally stable backing member with a desirable controlled elongation profile. Such a result is believed totally unexpected as a more open fabric is, or course, capable of even greater elongation during use than is a fabric of higher cover.

BRIEF DESCRIPTION OF THE DRAWING

The invention will be better understood by referring to the drawing in conjunction with reading the specification wherein in.

DETAILED DESCRIPTION OF THE INVENTION AND PREFERRED EMBODIMENTS

Figure 1:
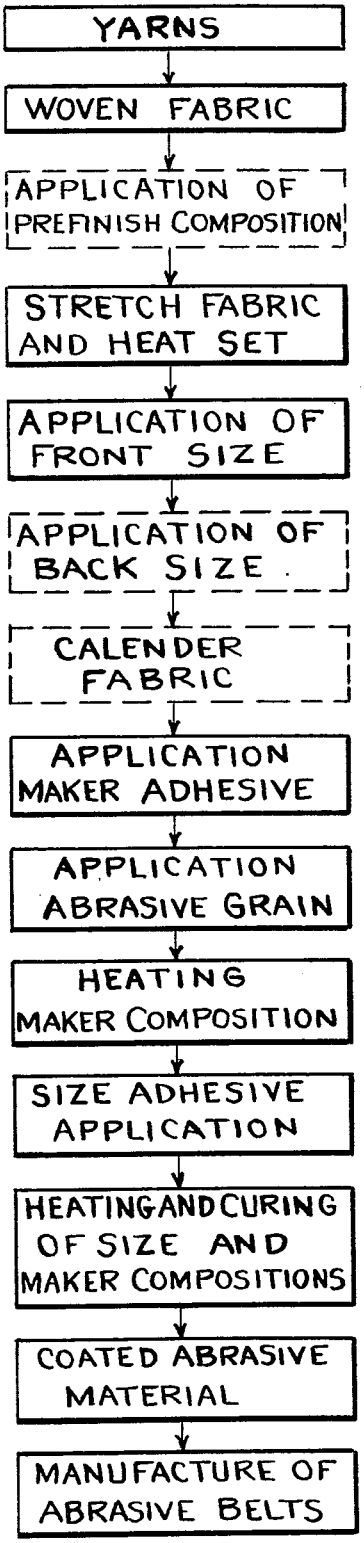
FIG. 1 is shown a block diagram representing the various procedural steps involved in practicing the invention.

Reference is made to the drawing wherein in FIG. 1 is shown a block diagram indicating the various procedural steps involved in the preferred manner of making a dimensionally stabilized fabric and coated abrasive therefrom, all in accordance with the invention.

As shown in FIG. 1, yarns are assembled together into a woven fabric of some desired construction. Although the term "yarns" is used throughout the specification, it should be understood that the term covers yarns whether of multifilament, or staple fibers. In fact, the term "fiber" is used generically to include both filament and staple material.

The yarns used in the practice of this invention are of polyester fibers, e.g., polyethylene terephthalate, made, e.g., by the condensation of dimethyl terephthalatic acid and ethylene glycol. Such a fibrous material is available commercially from a number of sources, e.g., E. I. Du Pont de Nemours and Co., Inc., of Wilmington, Del. markets such a fibrous material under the trademark "Dacron". Other polyesters which will be found suitable in the practice of the invention include Terylene, a condensation product of dimethyl terephthalate and ethylene glycol; Kodel, a condensation product of 1, 4 cyclohexane dimethanol and tetephthalic acid; Fortrel, a polyethylene terephthalate, Vycron, a modified polyethylene terephthalate; and A-Tell, a polyethyleneoxybenzoate from the reaction of p-hydroxybenzoic acid and ethylene oxide. In general, any fiber forming polyester will be found satisfactory.

As before-mentioned, the yarns used in the practice of the invention can be of either staple or multifilament fibers depending on the particular grinding application. Where maximum adhesion is desired between the maker adhesive and backing member, staple fiber yarns are more desirable. Multifilament yarns, however, offer the backing member of greater strength. The fabric rather than being of all staple fiber yarns or continuous filament yarns can be, e.g., continuous filament yarns in the warp direction and staple fiber yarns in the fill direction. Such a fabric as last described offers a good combination of tensile strength and adhesion characteristics. Moreover, where spun yarns are used in the fill direction, this increases the friction effect of the yarn at the crossing points with the warp yarns and improves the strength-elongation profile of the web by restraining the slippage normally experienced with high strength multifilament yarns.

The stable fiber yarns found useful in the practice of the invention will, in general, be found to have yarn numbers varying from 6's to 30's, the higher the number, the finer the yarn. Yarn number is based on a unit length of 840 yards, and the count of the yarn is equal to the number of 840 yard skeins required to weigh 1 pound.

Where filamentary yarns are used in the practice of the invention, the yarns will have a tenacity of from 4.5 to 9.2, a denier of from 220 to 1500, preferably 840 to 1200 denier, and have only producers twist.

The polyester yarn is woven in conventional fashion into a fabric of relatively loose construction, e.g., 13 × 13 to 80 × 55 being the range of warp and fill ends which will be found useful. In general, the higher is the weight of the yarn per unit length, i.e., lower the yarn count, or higher the denier, the lower is the number of warp ends and fill picks per inch. Various weave patterns can be used such as a plain weave, twills, and sateens, the choice of weave pattern depending somewhat on the particular application for the coated abrasive material. Fabrics found useful in the practice of the invention will be found to weight from 2.8 to 10 ounces-/yd.$^2$, preferably 4 to 7.0 ounces/yd.$^2$.

Those fabrics which will be found useful, and which can be processed into a fabric in accordance with the invention must have, and this is critical, a cover varying only from 40 to 80 percent. With covers higher than this, on pull-down, jamming occurs. Lower covers result in an undesirably open fabric after pull-down, this permitting strike-through of the maker adhesive and a non-uniform adhesive grain layer.

Cover is determined, as earlier described, in the case of fabrics woven from staple yarns. However, where multifilament yarns are used, denier must be converted into cotton count to enable one to use the formula. This is accomplished by dividing 5315 by the denier.

As is usual, although not shown in the drawing, a so-called "mill size" is provided on the warp yarns prior to, and to aid in weaving. There are various materials which may be found suitable for this purpose; however, we have found a composition comprising polyvinyl alcohol and polyacrylic acid to be quite satisfactory, as it can also double as a prefinish, as hereinafter is more fully described. Such a composition is disclosed in British Pat. No. 1,256,761. Other mill sizes which will be found satisfactory include sodium polyacrylate and polyvinyl alcohol. In some instances, as is conventional, the woven fabric is scoured to remove any mill size thereon to prepare the fabric for other cloth finishing treatments. This may be done, for example, if the prefinish composition chosen, hereinafter discussed, does not have the most desirable adhesion characteristics with the mill size.

The tension which is applied to the greige fabric is rather extreme compared to the tension applied to a cotton fabric conventionally processed in a pull-down operation. Tension applied will depend, of course, among other things, on the particular fabric construction, yarns, i.e., whether staple or multifilament yarns are used in the fabric, yarn size, openness and fabric width. Higher tensions will be used with multifilament yarn fabrics or fabrics in which only the warp yarns are multifilament yarns. This will be found particularly necessary where higher denier, e.g. 840 denier and higher, yarns are used.

Processing speeds will be found to depend somewhat on the particular fiber being heat stretched. However, speeds of from 60 ft./min. to 270 ft./min. will be found satisfactory. The lower speeds should be used where the fabric is of staple yarns or relatively low denier filamentary yarn.

While in the stretched condition, the fabric is subjected to heat in the range from about 380° F. to 475° F. for from 0.5 to 2.0 minutes. Thereafter, the tension is relaxed and the fabric will remain set, "i.e., stabilized in its new configuration".

The key in the preparation of the fabric backing member to eliminate the undesirable stretch or elongation in the coated abrasive material resides in the construction of the greige fabric subjected to heat stretching. As before disclosed, the fabric cover must be sufficiently low to permit the number of warp yarns to increase per inch of width so that the fabric, crimp and yarn elongation are removed to the desired level without jamming the yarns in the surface of the fabric thereby causing it to rupture. In addition to the critical fabric cover, the temperature to which the fabric is subjected and the pulling force are necessary to accomplish the objectives of the invention. The temperature should be such that the yarn of the fabric are heated to just below their softening point so that the polyester material is in the plastic state. As the fabric comprises polyester yarns, dry heat must be used; otherwise, the fibers will pyrolyze and degrade. It is equally important that the width of the fabric be controlled during the stretching by restraining the fabric edges to provide a controlled predetermined amount of lateral width shrinkage. In any case the width is reduced by no more than 25% of its total width and preferably by no more than 20%. It is also essential that the restrained edges of the fabric move at the same (and changing) speed as the center of the fabric to prevent bowing or skewing of the fill yarns.

After hot stretching, fabric cover will be found to have increased substantially and will be on the order of 75 to 97%. The preferred cover is from 80 to 95%. As used herein, "cover" in the stretched fabric is calculated on the basis of the weight of the fabric yarns before stretching. Thus, a fabric is provided which results in a desirable combination of adhesion characteristics, i.e., good mechanical adhesion is provided with the maker adhesive, and a satisfactorily uniform maker adhesive-grain layer results.

Optionally, prior to the heat stretching operation, a prefinish composition can be applied to the greige fabric. Various materials can be used for this purpose. However, in general, the materials are of a thermosetting resinous nature. One material found suitable is a resorcinol-formaldehyde resinous condensate such a resin being disclosed in British Pat. No. 1,260,461. A complex phenolic based compound in dilute ammonia that is sold commercially under the trade designation H-7 by Imperial Chemical Industries will also be found to increase adhesion in certain instances. Polyvinyl alcohols, as disclosed in U.S. Pat. No. 3,044,891 can also be used. However, in certain instances, the same purposes may be accomplished, as before mentioned, in not scouring the fabric, e.g., where the mill size applied is polyvinyl alcohol. In general, the quantity of prefinish applied should amount to about 5% (dry weight) based upon the fabric weight. The prefinish is applied from solution, and where a three zone hot stretching unit is used, drying occurs in the first zone.

After the heat stretching operation, a front size composition is applied to the backing member to promote adhesion between the backing member and maker adhesive. This serves also to promote a smoother and more uniform surface for application of the maker adhesive.

The preferred front size composition comprises a mixture of phenolic resins of different formaldehyde factors, the composition being described more completely hereinafter in the example set forth. The resinous mixture is deposited from aqueous solution, the amount deposited being, on a dry basis, 5.0 ± 1 lb./sandpaper makers ream (S.P.M.R.). Drying is conducted in stepwise fashion, as is conventional for phenolic resin compositions.

Where increased abrasion resistance is desired on the backing member for any particular grinding application, a back size can optionally be applied to the back side of the backing member. A suitable composition for the back size is a composition comprising, in general, in admixture equal parts of a resol phenolic comprising bisphenol A and an acrylate resin composition. The back size composition is applied in aqueous form, sufficient composition being applied to result in a dry weight of 6.0 ± 2.0 lb./S.P.M.R. The back size composition will, in general, be applied before the front size; however, there is no reason why it can't be applied after application and drying of the front size composition.

The remainder of the process involves conventional abrasive manufacturing technology and is believed to require no detailed explanation herein. In general, a maker adhesive is applied to the front face of the dimensionally stabilized woven fabric of polyester yarns, followed by application of abrasive grain, and heating of the maker adhesive to partially cure it. Next, a size adhesive, of the same or a different composition as the maker adhesive, is applied to the abrasive grain, after which the coated web is heated to further cure the maker and size adhesive. The coated abrasive material is then ready to be manufactured into abrasive belts or other abrasive articles, e.g., sheets, rolls, discs, and the like.

The preferred maker adhesive is phenol-formaldehyde resin, a heat-hardenable resinous material long used in the manufacture of coated abrasive material. However, other resinous materials may be used such as urea-formaldehyde, epoxy, and polyurethane.

The composition for the size coat can be of the same or different composition as the maker adhesive. It can be, for example, of the same phenolic composition as the maker adhesive but of a lower viscosity to provide for better application.

The abrasive grain used can be any of those conventionally used in the manufacture of coated abrasive material. These include aluminum oxide, silicon carbide, garnet, fused alumina-zirconia, and mixtures thereof. The abrasive grain can be applied electrostatically, as is conventional, or by gravity means. Where two abrasive grain layers are applied to the backing member, one can be applied by gravity and the other by electrostatic means.

Heating of the maker and size adhesive compositions is accomplished in stepwise fashion subsequent to application of each wet adhesive layer. Afterwards, the adhesive abrasive coated web is rolled up and final curing of the adhesive layers is accomplished.

In the heating zone, the fabric is heated to just below the softening point for the polyester material and for a time to allow the desired amount of stretching to occur. It is in this zone that the greatest amount of stretching of the fabric results, although some will occur in the drying and normalizing zones also.

The stretched fabric web is then passed to the so-called "normalizing zone" wherein it is heated under tension at a temperature and for a time sufficient to stabilize or heat set the fabric in its stretched condition. Thus, there results a fabric, compared to the greige fabric, of increased density and cover, and decreased elongation. As mentioned previously, the fabric edges are restrained during the stretching and normalizing to provide a predetermined width shrinkage.

Figure 2:
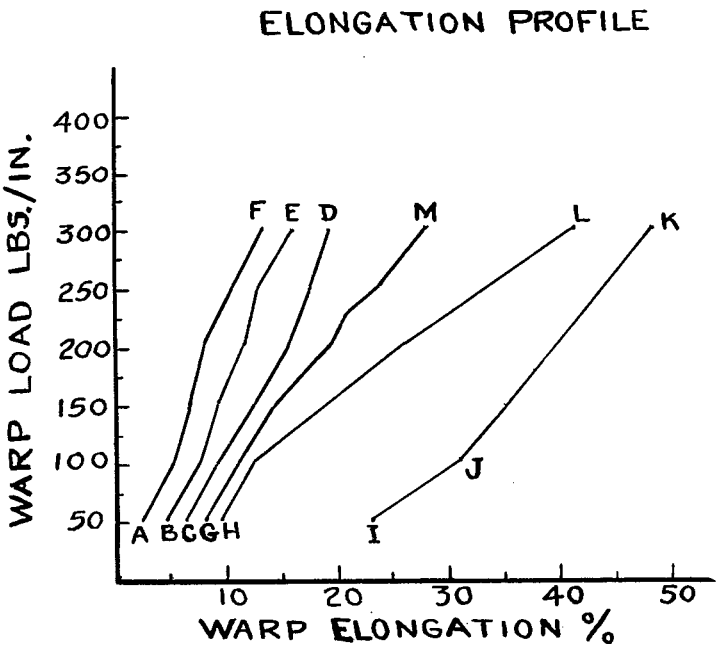
in FIG. 2 is shown a range of elongation profiles of a greige fabric before processing and a range of profiles of the same fabric after processing in accordance with the invention; and in FIG. 3 is shown a range of elongation profiles of coated abrasive material manufactured using backing members of the invention having elongation profiles defined as in FIG. 2.

Polyester fabrics in accordance with the invention are characterized by an elongation profile on or between the curves AF and CD in FIG. 2 of the drawing.

The elongation profile of a fabric is the stretch of the fabric in the direction specified, in this case the warp direction, at various intermediate tensile stresses prior to the breaking strength. It is best depicted pictorially by the stress-strain curve. Thus, such a curve is shown in FIG. 2, for the fabrics of the invention, as well as the greige fabrics.

As shown in FIG. 2, the greige fabrics have elongation profiles on or between the curves, GM and IK.

A typical elongation profile in the warp direction for a greige polyester staple yarn fabric is 8% at 50 lbs./in. tensile stress, 12% at 100 lbs./in., 25% at 150 lbs./in., 35% at 200 lbs./in., and 50% or more elongation at 300 lbs./in. tensile stress. It will be found however, that after the tensioning (with consequent stretching) and accompanied by the heating treatment, the fabric will remain permanently elongated and have an elongation profile, in the preferred instance, as indicated by the line B E in FIG. 2, of no more than 4% at 50 lbs./in. tensile stress, no more than 6% at 100 lbs./in., no more than 8% at 150 lbs./in., no more than 10% at 200 lbs./in., no more than 12% at 250 lbs./in., and no more than 15% at 300 lbs./in.

Figure 3:
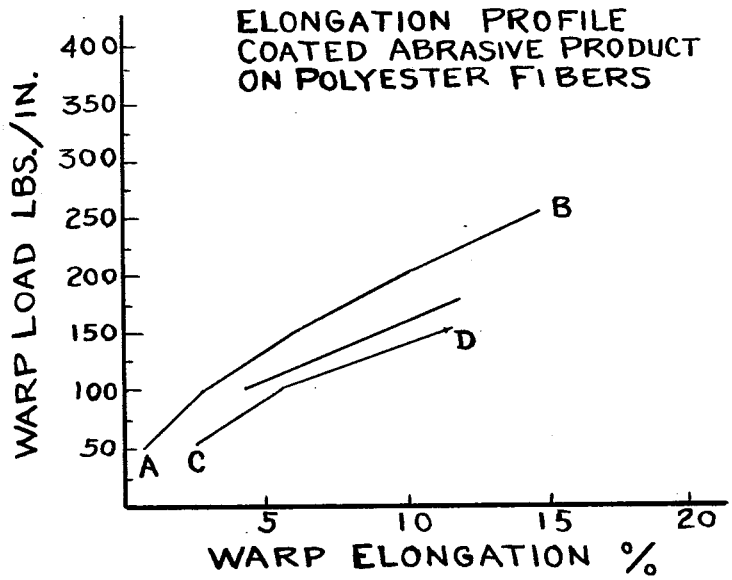

After manufacture into coated abrasive material, the elongation profile changes somewhat, as would be expected. This is shown in FIG. 3. However, it should be pointed out that at maximum warp tensile, elongation is less than 15%. Thus it is indicated that backing member elongation is little effected by its use in coated abrasive material.

The following examples illustrate the more preferred embodiments of the invention.

EXAMPLE 1

A woven fabric (greige) of staple polyester fibers, 65½ in. wide, weighing 3.67 oz./sq. yd., in a 1 × 1 plain weave construction having a nominal yarn count of 66 × 44, a fabric cover of 66%, and with warp yarns of 26/1 and fill yarns of 19/1, is passed to a hot stretching unit as 60 ft./min. wherein it is heated to 435° F for 1 minute while being placed under tension across the web in the length direction. The width direction of the web is restrained from freely contracting by a stretching and flexible tenter.

Prior to heat stretching, the fabric is prefinished with a composition comprising 11 parts resorcinol, 16.2 parts formalin solution (37% formaldehyde), 0.3 part sodium hydroxide, and 238.4 parts water. The fabric is not scoured prior to being subjected to heat stretching.

The width of the fabric after heat stretching is 53 in. The yarn count is determined to have increased to 91 × 46, and the warp yarns are seen to be noticeably smaller in diameter. On the other hand, the fill yarns appear somewhat heavier than those in the greige fabric. The fabric cover of the heat stretched fabric is 77%, fabric weight is 4.56 oz./yd.$^2$.

The elongation profile of the heat stretched fabric is determined according to usual techniques on an Instron Tensile Tester. A 1 inch strip of backing material is used, gage length 3 inches, chart speed 12 in./min., jaw speed 12 in./min. An elongation of 2.9% at 50 lbs./in. tensile stress, 5.5% at 100 lbs., 10.8% at 150 lbs., and 12.1% at 155 lbs. breaking tensile is measured. By comparison, the elongation profile of the greige fabric is 23% at 50 lbs., and 30% at 92 lbs./in. breaking tensile stress.

Thus, one can readily see that pull-down of this magnitude results in a much more dense fabric and an increase in longitudinal tensile strength of rather large proportions as indicated by the relatively large decrease in warp elongation. The elongation profile of the heat stretched fabric is very important where the fabric is to be used as a backing member for coated abrasive material. Most coated abrasive belt machines have limited take-up devices and unless the stretch is controlled within their limits, the belts result in less than satisfactory performance.

The dimensionally stabilized fabric is next coated on its back side with a composition as follows:

| COMPONENT | PARTS BY WEIGHT |
|---|---|
| A | 1 |
| B | 1 |
| CaCO3 | 2 parts per each part solids A and B |

Component A is an aqueous resinous composition (72% solids concentration) comprising bisphenol A and formaldehyde (alkaline catalyzed) having a formaldehyde to phenol (F/P) ratio of 3.8 to 1. Component B is a composition as follows:

| COMPONENT | % BY WEIGHT |
|---|---|
| acrylonitrile | 13 |
| methyl methacrylate | 13 |
| butyl acetate | 17 |
| acrylamide | 1 |
| surfactant (nonionic) | 3 |
| water | 53 |

Sufficient composition is applied to result in after drying 7.0 lbs./sandpaper makers ream (S.P.M.R.). Drying is accomplished by heating for 0.33 min. at 200° F., 0.33 min. at 225° F., and 0.33 min. at 200° F.

A front size is then applied to the fabric front surface of the following composition:

| | COMPONENT | PARTS BY WEIGHT |
|---|---|---|
| (1) | a phenol-formaldehyde resin, F/P 0.94, NaOH catalyzed until pH=8.1, 78% solids in $H_2O$ | 1 |
| (2) | bisphenol A resin above | 9 |
| (3) | CaCO3 | equal to solids in (1) and (2) |

Drying is accomplished by heating for 0.33 min. at 225° F.; 0.33 min. at 275° F.; and 0.33 min. at 250° F. Sufficient front size composition is applied to result in a dry weight of 5.0 lbs./S.P.M.R.

A maker adhesive having the following composition is then applied to the front sized backing member in accordance with usual techniques:

| | COMPONENT | PARTS BY WEIGHT |
|---|---|---|
| (1) | phenol-formaldehyde alkaline catalyzed resol resin, F/P factor 2.08, pH 8.7, solids 78% in water | 7 |
| (2) | phenol-formaldehyde alkaline catalyzed resol resin, F/P 0.94, pH 8.1, solids in $H_2O$ 78% | 3 |
| (3) | CaCO3 | 1.54 × total solids (1) + (2) |

To the adhesively coated fabric is then applied by conventional electrostatic means 35.4 lbs./S.P.M.R. grit 60 high purity aluminum oxide abrasive grain. The abrasive-adhesive coated backing member is then heated for 25 mins. at 170° F., 25 mins. at 190° F., and 47 mins. at 225° F. to provide a dry adhesive layer (17.4 lbs./S.P.M.R.) and to anchor the abrasive grains in the desired orientation.

Afterwards, a size coat (10.6 lbs./S.P.M.R. dry) of the same composition as the maker coat, except of lesser viscosity, is then applied according to usual techniques. The wet adhesive layer is then dried — 25 mins. at 125° F., 25 mins. at 135° F., 18 mins. at 180° F., 25 mins. at 190° F., and 15 mins. at 225° F. after which a final cure at 230° F. for 8 hours is given. The coated abrasive material is then ready to be manufactured according to usual techniques, into belts, discs, and other desired abrasive products.

EXAMPLE 2

A 2 × 1 twill weave fabric, 64 in. wide, is provided of staple polyester yarns (warp yarns of 12/1, fill yarns of 15/1), the warp yarns having been sized according to usual techniques with polyvinyl alcohol. The woven fabric has a yarn count of 64 × 46 and weighs 6.0 ounces per square yard.

The fabric is coated by means of a knife over roll coater with an aqueous prefinish composition of resorcinol and formaldehyde as described in Example 1.

The fabric is heat stretched in a three zone hot stretching unit wherein in the first zone the fabric is heated with hot air at 475° F. for 45 seconds, in the second zone the fabric is heated at 360° F. for 30 seconds, and in the third zone the fabric is heated at 435° F. for 45 seconds. Afterwards, the fabric is cooled down to a temperature approaching room temperature by high volume recycled air just before takedown.

Prior to passing into the first heating zone, the wet fabric is passed over a suction roll wherein excess liquid is removed. Solids deposited on the web amount to about 1% by weight of the fabric (dry).

The fabric width is controlled during passing through the hot stretch unit by a flexible and stretchable tenter chain which holds the fabric by conventional means. Spreader rolls are located at oven exit and entrance ports to aid in maintaining web width.

Sufficient tension is applied to the fabric during hot stretching to increase the fabric count to 80 × 44. This results in a fabric cover of 89.6% compared to 79.9% in the greige fabric.

On visual examination, it will be observed that the warp yarns are somewhat leaner; the fill yarns, however, appear somewhat heavier.

EXAMPLE 3

A 66 in. wide fabric in a 1 × 1 plain weave construction of polyester staple fiber yarns, warp yarn numbers 26/1, fill yarns 15/1, weighing 4 oz./sq. yd., and having a yarn count of 66 in the warp direction and 42 in the fill, is finished by immersing the fabric in an aqueous composition containing monomers of resorcinol and formaldehyde as before described.

The fabric is then squeezed with padder rolls to remove excess finish after which it is subjected to a drying operation. Sufficient finish is applied to provide approximately 5% (by weight) solids of resorcinol-formaldehyde after drying.

After application of the prefinish composition, the fabric is passed (at 60 ft./min.) to a gas fired three zone hot stretching oven. The oven has a first zone temperature of 475° F., a second zone temperature of 380° F., and a third zone temperature of 435° F. In the first zone, substantial stretching of the fabric occurs; the finish composition is cured in the second zone, and in the third zone, the fabric is nominally stretched and relaxed. The fabric is subjected to each zone conditions for about 1 minute.

The fabric passes from the hot stretch unit and is cooled down to a temperature approaching room temperature by high volume recycled air just before takedown.

The warp tensile-elongation profile is determined to be 2.3% elongation of 50 lbs., 5.5% elongation at 100 lbs., and 12.1% elongation at 155 lbs. breaking tension. Compared to this the tensile-elongation profile of the greige fabric in the warp direction of the fabric is 50 lbs. tensile, 23% elongation, and 93 lbs. breaking tension with 32% elongation.

The heat stretched fabric is then treated on its back side with a back size composition as disclosed in Example 1. The composition is applied by means of a knife on floating web technique and in an amount to provide 1.0 lb./S.P.M.R. dry weight. Drying is accomplished as before described.

Afterwards, a front size composition comprising a mixture of phenolic resins of different formaldehyde factors (disclosed Example 1) is applied to the front side of the fabric, the front side being the side to which maker adhesive is to be later applied.

The fabric is then dried as before until the finish applied is tack-free.

The tensile-elongation profile of the finished cloth is 50 lbs. tension — 2.7% elongation, 100 lbs. tension — 6.3% elongation, 150 lbs. — 12.9% elongation, and 163 lbs. breaking tension — 14.8% elongation.

EXAMPLE 4

A 2 × 2 twill weave fabric (64 in. wide, 5.7 oz./yd.$^2$) having a fabric count of 58 × 44 is provided of polyester staple warp yarns-12's single and polyester staple fill yarns-15's singles.

This fabric, having a cover factor of 76%, is dipped in a finishing solution containing resorcinol-formaldehyde monomer, described earlier. Afterwards, the fabric is squeezed through padder rolls to remove excess solution and is immediately passed (30 ft./min.) into a hot stretching unit.

In the hot stretching unit, the fabric is subjected to a three zone curing and stretching operation, the temperature varying from 385° F. to 450° F. for from 2.0 min. to 0.5 min. in each of the zones.

After heat stretching, the fabric cover is 89%, warp end count 81, and the width 49.5 in.

The warp elongation profile is 3.3% at 100 lbs./inch tensile stress, 9.5% at 200 lbs., and 14.3% at 253 lbs. This compares to an elongation profile of the greige fabric of 11% at 50 lbs., 24.7% at 100 lbs., 33.7% at 150 lbs., and 44.3% at 191 lbs. breaking tension.

After applying a cloth finish as earlier disclosed, the elongation profile is 3.0% at 100 lbs. tension, 11.7% at 200 lbs., and 18.6% at 267 lbs. The elongation profile of coated abrasive material manufactured from the fabric is 0.7% at 50 lbs. tensile stress, 2.3% at 100 lbs., 6% at 150 lbs., 9.8% at 200 lbs., 14.3% at 250 lbs., and 16.9% at 271 lbs. breaking tensile stress.

The fill tensile and elongation is as follows:

a. after pull-down — 50.2% elongation at 82 lbs. tensile
b. after finish applied — 42.7% elongation at 67 lbs.
c. coated abrasive — 35.6% elongation at 106 lbs.

As previously mentioned the prefinish is not always required to carry out the spirit of the invention. In some grinding operations such as the flat grinding of steel, wood, etc., or in fine grit products for a variety of grinding applications it is not required.

What is claimed is:

1. Coated abrasive material comprising a dimensionally stabilized woven heat stretched fabric backing member in which the warp and fill yarns are composed of polyester fibers, said coated abrasive material having an elongation profile in the warp direction as defined by a line within the area to the left of the line CD in FIG. 3 of the drawing, a thermoset adhesive layer on the front side of the backing member, and abrasive grains attached to the backing member by the adhesive layer, the fabric cover of the woven backing being from 80 to 97%.

2. Coated abrasive material according to claim 1 in which a finish layer on the yarns comprises resorcinol-formaldehyde resin.

3. Coated abrasive material according to claim 1 in which said adhesive layer comprises phenol-formaldehyde resin.

4. Coated abrasive material in accordance with claim 1 wherein the elongation profile of the coated abrasive material in the warp direction lies between the lines AB and CD in FIG. 3 of the drawing.

5. Coated abrasive material in accordance with claim 1 in which the fill elongation per unit of load is substantially greater than the warp elongation.

* * * * *

BEST AVAILABLE COPY

Dedication 4,035,961.—*Raymond E. Pemrick*, Schenectady; and *Paul M. Cocanour;* Greenwich, N.Y. COATED ABRASIVE BACKING OF DIMENSIONALLY STABILIZED HEAT STRETCHED FABRIC. Patent dated July 19, 1977. Dedication filed Oct. 20, 1980, by the assignee, *Norton Company.*

Hereby dedicates to the Public the entire term of said patent.

[*Official Gazette December 23, 1980*]